US009007771B2

(12) United States Patent
Agostini

(10) Patent No.: US 9,007,771 B2
(45) Date of Patent: Apr. 14, 2015

(54) MULTI-ROW THERMOSYPHON HEAT EXCHANGER

(75) Inventor: Bruno Agostini, Dietikon (CH)

(73) Assignee: ABB Research Ltd., Zurich (CH)

( * ) Notice: Subject to any disclaimer, the term of this patent is extended or adjusted under 35 U.S.C. 154(b) by 239 days.

(21) Appl. No.: 12/768,339

(22) Filed: Apr. 27, 2010

(65) Prior Publication Data

US 2010/0277870 A1 Nov. 4, 2010

(51) Int. Cl.

| | |
|---|---|
| ***H05K 7/20*** | (2006.01) |
| ***F28D 15/02*** | (2006.01) |
| ***F28D 1/04*** | (2006.01) |
| *F28D 21/00* | (2006.01) |

(52) U.S. Cl.

CPC ..... *F28D 15/0266* (2013.01); *F28D 1/0435* (2013.01); *F28D 2021/0029* (2013.01); *F28D 2021/0031* (2013.01); *F28D 15/0233* (2013.01)

(58) Field of Classification Search

CPC ..... H05K 7/20; H01B 9/06; H02G 3/03; F28D 15/00; G06F 1/20; H01L 23/4006; H01L 23/467; H01L 23/427; H01L 23/4093; H01L 23/3672; H01L 2023/405; H01L 2023/4081; H01F 27/18; H01F 27/12; H01F 27/08

USPC ..... 361/701, 689, 696

See application file for complete search history.

(56) References Cited

U.S. PATENT DOCUMENTS

| | | | | |
|---|---|---|---|---|
| 3,416,600 A | | 12/1968 | Fink | |
| 4,001,548 A | | 1/1977 | Bauer | |
| 4,546,608 A | * | 10/1985 | Shiina et al. | 60/649 |
| 4,602,679 A | * | 7/1986 | Edelstein et al. | 165/104.26 |
| 4,686,961 A | * | 8/1987 | Garrison | 126/635 |
| 4,917,173 A | * | 4/1990 | Brown et al. | 165/274 |
| 4,949,164 A | * | 8/1990 | Ohashi et al. | 257/715 |
| 4,998,580 A | * | 3/1991 | Guntly et al. | 165/133 |
| 5,033,539 A | | 7/1991 | Kohtaka | |
| 5,099,576 A | * | 3/1992 | Shinmura | 29/890.049 |
| 5,205,353 A | * | 4/1993 | Willemsen et al. | 165/170 |
| 5,267,611 A | * | 12/1993 | Rosenfeld | 165/168 |
| 5,303,770 A | * | 4/1994 | Dierbeck | 165/140 |

(Continued)

FOREIGN PATENT DOCUMENTS

| | | |
|---|---|---|
| EP | 0 245 848 A1 | 11/1987 |
| EP | 2 031 332 A1 | 3/2009 |

(Continued)

OTHER PUBLICATIONS

Office Action issued by the U.S. Patent and Trademark Office in the U.S. Appl. No. 12/768,383, mailed Jan. 30, 2014, U.S. Patent and Trademark Office, Alexandria, VA. (15 pages).

(Continued)

*Primary Examiner* — Andargie M Aychillhum

(74) *Attorney, Agent, or Firm* — Buchanan, Ingersoll & Rooney PC

(57) ABSTRACT

A thermosyphon heat exchanger includes a first set of first conduit elements for heat absorbing and a second set of second conduit elements for heat releasing. A first end of the first set can be connected to a first end of the second set by at least one manifold and a second end of the first set is connected to a second end of the second set by at least one other manifold. At least one first set of first conduit elements and the at least one second set of second conduit elements are at least partially arranged such that a stack is formed.

18 Claims, 3 Drawing Sheets

(56) References Cited

U.S. PATENT DOCUMENTS

| | | | | |
|---|---|---|---|---|
| 5,329,996 | A * | 7/1994 | Rosenfeld | 165/168 |
| 5,379,830 | A | 1/1995 | Itoh | |
| 5,469,915 | A * | 11/1995 | Cesaroni | 165/171 |
| 5,538,079 | A * | 7/1996 | Pawlick | 165/153 |
| 5,638,900 | A * | 6/1997 | Lowenstein et al. | 165/168 |
| 5,692,558 | A * | 12/1997 | Hamilton et al. | 165/80.4 |
| 5,695,007 | A * | 12/1997 | Fauconnier et al. | 165/128 |
| 5,713,413 | A * | 2/1998 | Osakabe et al. | 165/104.33 |
| 5,729,995 | A * | 3/1998 | Tajima | 62/259.2 |
| 5,790,376 | A * | 8/1998 | Moore | 361/700 |
| 5,899,265 | A * | 5/1999 | Schneider et al. | 165/104.33 |
| 5,901,037 | A * | 5/1999 | Hamilton et al. | 361/699 |
| 5,924,481 | A * | 7/1999 | Tajima | 165/104.33 |
| 5,940,270 | A * | 8/1999 | Puckett | 361/699 |
| 6,005,772 | A * | 12/1999 | Terao et al. | 361/699 |
| 6,084,771 | A * | 7/2000 | Ranchy et al. | 361/699 |
| 6,119,767 | A * | 9/2000 | Kadota et al. | 165/104.33 |
| 6,341,645 | B1 * | 1/2002 | Tanaka et al. | 165/104.33 |
| 6,357,517 | B1 | 3/2002 | Osakabe et al. | |
| 6,405,792 | B1 * | 6/2002 | Rosenfeld et al. | 165/164 |
| 6,523,606 | B1 | 2/2003 | Dienhart et al. | |
| 6,546,999 | B1 | 4/2003 | Dienhart et al. | |
| 6,668,910 | B2 * | 12/2003 | Gawve | 165/80.3 |
| 6,687,122 | B2 * | 2/2004 | Monfarad | 361/679.54 |
| 6,804,117 | B2 * | 10/2004 | Phillips et al. | 361/700 |
| 6,809,424 | B2 * | 10/2004 | Pike et al. | 257/782 |
| 6,840,308 | B2 * | 1/2005 | Ritter et al. | 165/80.4 |
| 6,840,311 | B2 | 1/2005 | Ghosh et al. | |
| 6,874,567 | B2 * | 4/2005 | Ohara | 165/104.21 |
| 6,898,082 | B2 * | 5/2005 | Dessiatoun et al. | 361/699 |
| 6,938,685 | B2 * | 9/2005 | Duerr et al. | 165/148 |
| 6,988,541 | B2 * | 1/2006 | Nakajima et al. | 165/140 |
| 6,993,838 | B1 | 2/2006 | Staffa et al. | |
| 7,007,746 | B2 * | 3/2006 | Wu et al. | 165/104.26 |
| 7,017,655 | B2 * | 3/2006 | Wilson et al. | 165/80.4 |
| 7,017,657 | B2 * | 3/2006 | Sugito et al. | 165/104.21 |
| 7,077,189 | B1 * | 7/2006 | Reyzin et al. | 165/80.4 |
| 7,234,511 | B1 * | 6/2007 | Lesage | 165/69 |
| 7,262,966 | B2 * | 8/2007 | Liao | 361/699 |
| 7,290,597 | B2 | 11/2007 | Takano | |
| 7,435,623 | B2 * | 10/2008 | Chrysler et al. | 438/122 |
| 7,549,465 | B2 * | 6/2009 | Gong et al. | 165/173 |
| 7,571,618 | B2 * | 8/2009 | Dessiatoun | 62/259.2 |
| 7,665,511 | B2 * | 2/2010 | Bhatti et al. | 165/104.33 |
| 7,770,632 | B2 * | 8/2010 | Bhatti et al. | 165/104.33 |
| 7,819,174 | B2 * | 10/2010 | Huang et al. | 165/80.4 |
| 7,958,934 | B2 * | 6/2011 | Nara et al. | 165/80.4 |
| 2001/0004935 | A1 * | 6/2001 | Sanada et al. | 165/110 |
| 2001/0006101 | A1 * | 7/2001 | Chu et al. | 165/80.3 |
| 2002/0014324 | A1 * | 2/2002 | DiPaolo | 165/122 |
| 2002/0179284 | A1 * | 12/2002 | Joshi et al. | 165/80.3 |
| 2003/0010477 | A1 * | 1/2003 | Khrustalev et al. | 165/104.33 |
| 2003/0079864 | A1 | 5/2003 | Ohara | |
| 2003/0121649 | A1 * | 7/2003 | Seiler et al. | 165/167 |
| 2003/0147214 | A1 * | 8/2003 | Patel et al. | 361/699 |
| 2003/0192677 | A1 * | 10/2003 | Rong | 165/109.1 |
| 2004/0069459 | A1 * | 4/2004 | Tonosaki et al. | 165/104.25 |
| 2004/0099407 | A1 * | 5/2004 | Parish et al. | 165/104.14 |
| 2004/0104020 | A1 * | 6/2004 | Haller et al. | 165/177 |
| 2004/0134641 | A1 | 7/2004 | Tanaka | |
| 2004/0163798 | A1 | 8/2004 | Ghosh et al. | |
| 2004/0179338 | A1 * | 9/2004 | Belady et al. | 361/700 |
| 2005/0006061 | A1 * | 1/2005 | Quisenberry et al. | 165/104.33 |
| 2005/0024831 | A1 * | 2/2005 | Phillips et al. | 361/700 |
| 2005/0039887 | A1 * | 2/2005 | Parish et al. | 165/104.14 |
| 2005/0056403 | A1 * | 3/2005 | Norlin et al. | 165/104.33 |
| 2005/0194124 | A1 * | 9/2005 | Geiger et al. | 165/179 |
| 2005/0217829 | A1 * | 10/2005 | Belits et al. | 165/104.33 |
| 2005/0286230 | A1 * | 12/2005 | Yatskov | 361/709 |
| 2006/0000582 | A1 * | 1/2006 | Phillips et al. | 165/104.21 |
| 2006/0060327 | A1 * | 3/2006 | Yu et al. | 165/70 |
| 2006/0254753 | A1 * | 11/2006 | Phillips et al. | 165/100 |
| 2007/0133175 | A1 * | 6/2007 | Wu | 361/704 |
| 2007/0242438 | A1 * | 10/2007 | Belits et al. | 361/700 |
| 2007/0246206 | A1 * | 10/2007 | Gong et al. | 165/173 |
| 2007/0251671 | A1 * | 11/2007 | Barnes et al. | 165/83 |
| 2007/0284093 | A1 * | 12/2007 | Bhatti et al. | 165/104.33 |
| 2007/0295488 | A1 * | 12/2007 | Fielding et al. | 165/104.33 |
| 2008/0266884 | A1 * | 10/2008 | Bogner et al. | 362/373 |
| 2009/0056916 | A1 * | 3/2009 | Yesin et al. | 165/104.21 |
| 2009/0101308 | A1 * | 4/2009 | Hardesty | 165/80.4 |
| 2009/0107663 | A1 * | 4/2009 | Weber et al. | 165/288 |
| 2009/0166022 | A1 * | 7/2009 | Desai et al. | 165/279 |
| 2009/0228150 | A1 * | 9/2009 | Alston | 700/276 |
| 2009/0229794 | A1 * | 9/2009 | Schon | 165/104.21 |
| 2009/0308571 | A1 * | 12/2009 | Thompson et al. | 165/79 |
| 2009/0308583 | A1 * | 12/2009 | Dees et al. | 165/181 |
| 2010/0108303 | A1 * | 5/2010 | Sundralingam et al. | 165/153 |
| 2010/0175862 | A1 * | 7/2010 | Franklin et al. | 165/175 |
| 2010/0218511 | A1 * | 9/2010 | Rockenfeller | 62/3.1 |

FOREIGN PATENT DOCUMENTS

| | | | |
|---|---|---|---|
| JP | 59-018387 | A | 1/1984 |
| JP | 7-198279 | A | 8/1995 |
| JP | 9-167818 | A | 6/1997 |
| JP | 10-335550 | A | 12/1998 |
| JP | 2001-227886 | A | 8/2001 |
| JP | 2003-130561 | A | 5/2003 |

OTHER PUBLICATIONS

Office Action dated Jul. 18, 2013 issued by the USPTO in corresponding U.S. Appl. No. 12/768,383.

European Search Report dated Oct. 6, 2009.

Office Action issued by the U.S. Patent and Trademark Office in U.S. Appl. No. 12/768,383 dated Nov. 18, 2014.

Office Action issued by the U.S. Patent and Trademark Office in U.S. Appl. No. 12/768,383, mailed Jul. 17, 2014. (17 pages).

* cited by examiner

MULTI-ROW THERMOSYPHON HEAT EXCHANGER

RELATED APPLICATIONS

This application claims priority under 35 U.S.C. §119 to European Patent Application No. 09158996.0 filed in Europe on Apr. 29, 2009, the entire content of which is hereby incorporated by reference in its entirety.

FIELD

The disclosure relates to a thermosyphon heat exchanger and to an electric and/or electronic device including a thermosyphon heat exchanger.

BACKGROUND INFORMATION

A thermosyphon heat exchanger can be a powerful cooling device for cooling power electronic modules. It can increase cooling performance while decreasing weight, volume and required air pressure drop. A thermosyphon heat exchanger uses the phase transition of a refrigerant to subduct the heat of the electronic module (e.g., to vaporize the refrigerant by the heat of the power electronic module). The refrigerant-vapor rises in a closed loop of tubes and can be conducted to an actively cooled condenser, where the vapor condenses back to the liquid refrigerant. The re-condensed refrigerant can be lead back to vaporizing part of the cooling circuit.

U.S. Pat. No. 6,357,517, the disclosure of which is hereby incorporated by reference in its entirety, discloses thermosyphon heat exchangers for power electronic modules. Electronic modules can be mounted on vertically arranged vapor passages and the refrigerant condenses in separated condensed liquid passages. Thus, the rising vapor may not interfere the sinking and condensing refrigerant. Known thermosyphon heat exchangers is that they are custom made for very small quantities. Thus, an individual adaption of the size of vapor passages and condensed liquid passages for the conditions of different power electronic modules would further reduce the quantities of the thermosyphon heat exchangers. Large or many vapor passages or condensed liquid passages, respectively, enlarge the cooling power of the thermosyphon heat exchanger, but also increase production costs and volume.

SUMMARY

A thermosyphon heat exchanger is disclosed, comprising at least one heat absorbing first set of first conduit elements and at least one heat releasing second set of second conduit elements, a first end of the first set being fluidly connected to a first end of the second set by at least one manifold and a second end of the first set being fluidly connected to a second end of the second set by at least another manifold, the at least one first set and the at least one second set being at least partially arranged such that a stack is formed.

An electric and/or electronic device is disclosed, comprising: at least one heat emitting electric component that is thermally connected to at least one thermosyphon heat exchanger, the thermosyphon heat exchanger comprising: at least one first set of first conduit elements for absorbing heat; and at least one second set of second conduit elements for releasing heat, a first end of the first set being fluidly connected to a first end of the second set by at least one manifold and a second end of the first set being fluidly connected to a second end of the second set by at least another manifold, the at least one first set and the at least one second set being at least partially arranged such that a stack is formed.

BRIEF DESCRIPTION OF THE DRAWINGS

Different exemplary embodiments of a thermosyphon heat exchanger according to the disclosure will be described with reference to the drawings, wherein.

DETAILED DESCRIPTION

Figure 1:
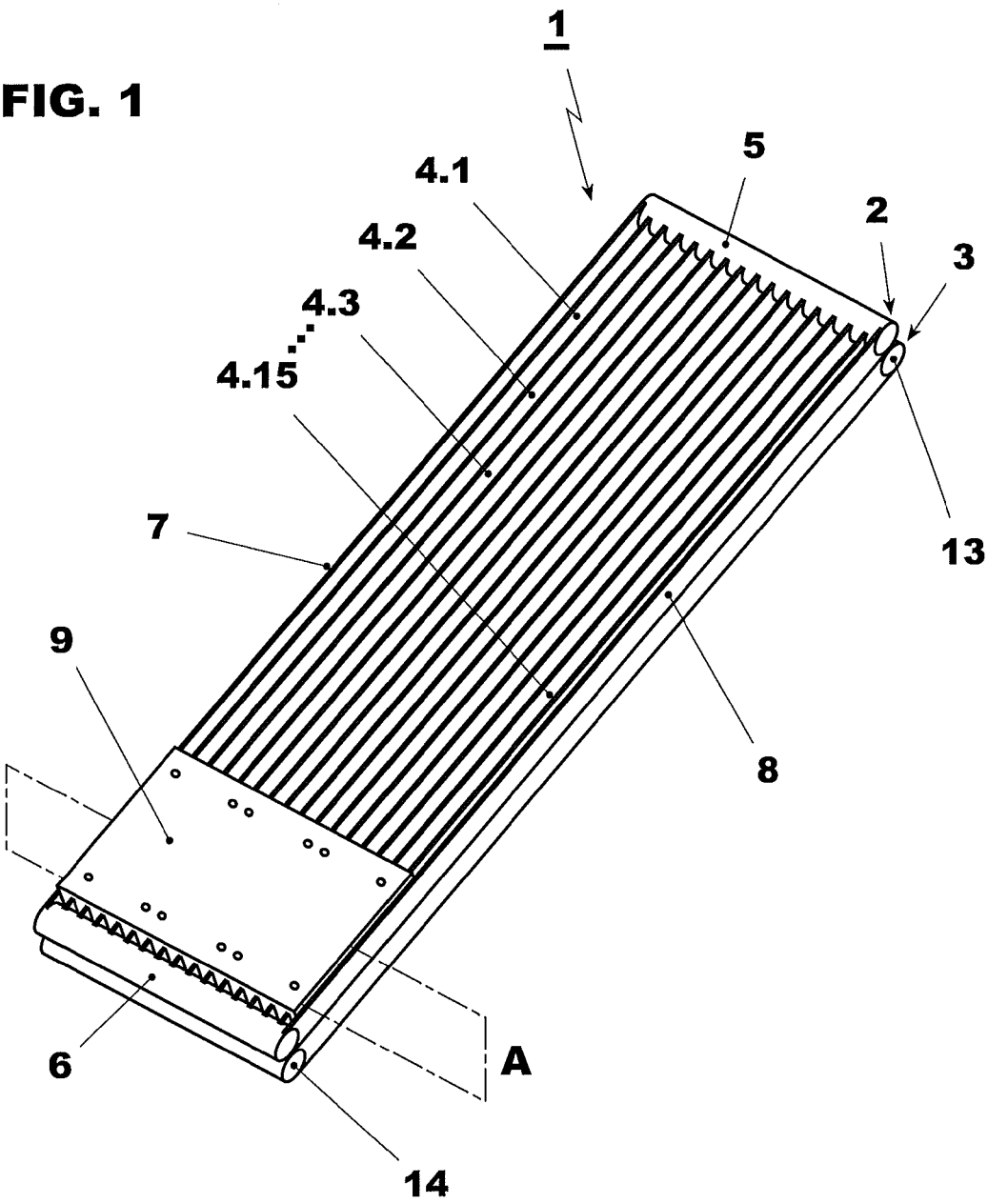
FIG. 1 is a schematic, three-dimensional illustration of a first exemplary embodiment of a thermosyphon heat exchanger when viewed towards a first set of first conduit elements.

An exemplary embodiment of a thermosyphon heat exchanger as disclosed herein can involve a lower redesign effort compared to known devices if a main factor changes (e.g., the desired cooling performance, size and/or space particularities).

An exemplary embodiment of a thermosyphon heat exchanger includes a first set of first conduit elements for heat absorbing and a second set of second conduit elements for heat releasing. A first end of the first set of first conduit elements can be fluidly connected to a first end of the second set of second conduit elements by at least one manifold. A second end of the first set of first conduit elements can be fluidly connected to a second end of the second set of second conduit elements by at least one manifold. Thus, the exemplary thermosyphon heat exchanger can provide flow in a closed loop through the first conduit elements and the second conduit element. The at least one first set of first conduit elements and the at least one second set (3, 22) of second conduit elements can be at least partially arranged in a stack.

If at least some sets of first and second manifolds are fluidly connectable by couplings, for example by detachable couplings, a stacking depending on desired thermal specifications can become even more easy. Where desired, the couplings can be self-locking couplings allowing the connection of two neighboring sets of conduit elements that can be prefilled with liquid refrigerant in order to enhance the manufacturability of a stack and for contributing to a pre-testing of each individual set of conduit elements prior to assembly. Where desired, a stack of sets of conduit elements can include at least one first set of conduits forming the evaporator section and at least one second set of conduits forming the evaporator section (e.g., one first set and two second sets). An exemplary thermosyphon heat exchanger can be characterised with at least two sets of the first set and the second set of conduits being fluidly connected to one another by couplings, for example, by detachable couplings.

With a separation into a first set of first conduit elements for heat absorbing and a second set of second conduit elements for heat releasing, the number of first conduit elements and the number of second conduit elements, and, for example, their cross section in each set, can be adapted individually to desired specifications. The stacked arrangement of the two sets of conduit elements reduces the space demand of the exemplary thermosyphon heat exchanger or more specifically its width compared to known devices. The separation of the vaporization and condensation section can improve the cooling performance.

Additionally, the exemplary thermosyphon heat exchanger can be more flexible in terms of possible variations compared to known devices in that no substantial redesign need be involved each time a main factor (e.g., required cooling performance, a size and/or space) that form main constraints to the thermosyphon heat exchanger, have to be adapted to fulfill such altered conditions. For example, the exemplary thermosyphon heat exchanger allows to vary merely one or several of the following core characteristics presuming that the kind and/or type of the conduits (e.g., a particular MPE (multiport extruded tubes) profile) shall remain unaffected. The core characteristics can be formed by a length of the first and/or second conduit elements and a width of the stack or set (e.g., the number of conduits of each set, as well as the number of sets of heat releasing conduits). The production costs can be further decreasable if the same profiles for the conduits are used if bought in bulk and due to uniform conduit treatment (e.g., by milling the end face portions).

It can be advantageous to use multiport extruded tubes as the first conduit elements and/or as the second conduit elements. Multiport extruded tubes, can be very effective standard cooling conduit elements that can be produced in very high quantities for many conditions of usage, such as for cooling devices used in the automotive industry, for example. Thus, the use of separate multiport extruded tubes as first and/or second conduit elements can reduce costs by limiting use of custom made conduit elements and at the same time allows the use of very effective and highly specialized conduit elements.

In an exemplary embodiment, the first and/or second conduit elements within the sets are arranged in parallel. Thus, a fresh cooling air flow can reach each of the conduit elements and may not be decelerated by further conduit elements where the air flow would have to pass, if the conduit elements are not arranged in parallel within the set. Assuming that the condenser section with the second conduit elements is cooled by a forced air flow provided by a fan, for example, it can prove to be advantageous to arrange the airflow on the condenser side of the exemplary thermosyphon heat exchanger device for at least two reasons. First, the air flow can be cooler and thus thermally more effective/efficient if it hits the condenser conduits prior to coming in contact with the evaporator conduit section located above the evaporation portion (e.g., above the heat absorbing plate at a mounting area provided for thermal coupling to the at least one electric and/or electronic power component). Second, an undesired pre-condensation of the vapor in the evaporator conduit section located above the evaporation portion can be kept low as the difference in temperature between the refrigerant-rich vapor and the interior walls of the condenser conduits can be smaller because the air can be pre-heated by the condenser conduits arranged upstream of the evaporator conduits. Alternatively and/or in addition, the most effective condenser section of the second conduit elements can be located above a more effective evaporator section of the first conduit elements when seen in the longitudinal axis, presuming a cooling flow (e.g., from a fan) is hitting the second conduit elements first prior to contacting the first conduit elements. For example, a more effective condenser section and a more effective evaporator section can be displaced about a distance against one another in the direction of the longitudinal axis defined by at least one of the first and/or second conduit elements.

The displacement can, for example, be defined such that a most effective condenser section and a most effective evaporator section do at least mainly not overlap when seen from a direction of the cooling flow. The thermosyphon heat exchanger can be dimensioned such that a length of the first conduit elements above the heat absorbing portion is minimal in order to prevent, or at least to hamper, an excessive condensation of the refrigerant vapor already in the first conduit elements to a large extent. Alternatively and/or in addition, the length of the evaporator conduit section of the first conduit elements located above the evaporation portion in a longitudinal axis defined by at least one of the stacks, a conduit and the exemplary thermosyphon heat exchanger device, can be balanced such that a condensation rate in the evaporator conduit section located above the evaporation portion can be as low as possible without unduly jeopardizing a fair condensation rate in the condensator conduits (e.g., the second conduit elements).

In an exemplary embodiment, the first conduit elements in the evaporator conduit section located above the evaporation portion may be shielded against the air flow by sheet-like flow protectors arranged in between the first and second conduit elements and extending in the longitudinal direction. Depending on the exemplary embodiment, these flow protectors may feature a crescent cross-section with reference to their longitudinal axis. Alternatively thereto, the first fluid transfer portion can be thermally isolated to the ambient (e.g., a forced air flow) by a suitable coating (e.g., a paint or laquer).

In combination with the arrangement of the sets of first and second conduit elements being arranged in neighboring and overlapping layers (e.g., arranged congruently in the stack), the parallel arrangement of the first and second conduit elements within the sets can be especially advantageous, because the fresh cooling air flow can cool effectively all of the second conduit elements for heat releasing and is not remarkably decelerated by the second row of parallel arranged first conduit elements. Furthermore, if like tubes and manifolds are used, an even more economic production can be achievable. Although the term congruent is to be understood as congruent in terms of an overall extension in the direction of a virtual plane defined by the first and/or second set, it shall not be limited to exemplary embodiments having sets of conduit elements with an identical number and an identical alignment of their conduit elements.

It can be furthermore advantageous to connect at least one end of the first and second set of first and second conduit elements by a common manifold, because only one manifold may be needed for connecting the first end of the sets of the first and second conduit elements and the production costs can be reduced.

It can be advantageous as well to fluidly connect at least one end of the first set of first conduit elements by a first manifold, to fluidly connect the corresponding end of the set of second conduit elements by a second manifold and to fluidly connect the first and second manifold. This can allow maximum flexibility to adapt the individual sets of conduits according to their requirements. For example, two manifolds would allow use of first and second conduit elements with different lengths, whereby the two manifolds are connected with a return line. It can also allow use of the like sets of conduit elements for the sets of the first and second conduit elements which simplifies the manufacturing process and contributes essentially to reduced overall costs by increasing the production quantity of both the coolers as well as the MPE profiles, where applicable.

It can be especially advantageous to mount a heat absorbing plate on the set/stack of first conduit elements. The heat absorbing plate forms a mounting plane or platform for fixing power electronic modules or any other heat producing devices to be cooled thereon. The heat absorbing plate transports the heat via large surfaces of thermal contact with an electronic module and with the first conduit elements from the electronic module to a refrigerant running within the first conduit elements. It can be further advantageous that the heat absorbing plate covers less than one half of the length of the first conduit elements to which it is thermally connected to, in order to allow the cooling air stream to pass through the rest of the first set of the first conduit elements not covered by the absorbing plate. For example, the heat absorbing plate covers less than about half of the first conduit elements in a longitudinal direction being defined by at least one of the exemplary thermosyphon heat exchanger, the first conduit elements and the second conduit elements. The term length is to be understood to expand in the direction of the longitudinal axis. A further advantage can be achievable by providing grooves in the heat absorbing plate surrounding and enclosing the conduit elements at least partly, which grooves have a shape that corresponds to the shape of the conduits. Thus, a large thermal contact surface of contact between the first conduit elements and the absorbing plate can be achieved.

It can be especially advantageous that the first region does not overlap with the absorbing plate. Though, the second conduit elements can, for example, be displaced in the direction of the longitudinal axis to the heat absorbing plate at a distance in such an exemplary embodiment. Because the second region of the second set of second conduit elements for heat releasing can be stacked in a neighbored layer/stack with the first region, the absorbing plate in the first region can block all the air stream passing in the second region and can stop any cooling effect presuming that the air stream that is led towards the heat exchangers hits the condenser stack first. Therefore, it can be as well advantageous that the second region covers the complete set of second conduit elements. Thus, the complete set of second conduit elements can cover, in combination with the last feature, only the first region not covered with the heat absorbing plate. This can provide an optimal cooling effect over the entire set of second conduit elements and does not enlarge the height and the width of the thermosyphon heat exchanger over the height and width of the set of first conduit elements. This can be realized by the second conduit elements being shorter with reference to the longitudinal direction than the first conduit elements and the second conduit elements having an intermediate manifold fluidly connected with one end of the second conduit elements and being further fluidly connected with a second manifold connected with the corresponding end of the longer first conduit elements. The heat releasing devices and the second set of conduit elements can thus be arranged on the same side of the first set of conduit elements. The term width can be understood in this description as running in a perpendicular direction with reference to the longitudinal axis for all exemplary embodiments.

The provision of the intermediate manifold can allow an increase in the degree of design freedom in that a condenser section formed by the first conduit elements and an evaporator section formed by the second conduit elements may include a different number of conduits. Thus, a separate optimization of the condenser section and the evaporator section can be achievable (e.g., in that the first conduit elements can be arranged relative to the second conduit elements in a displaced, such as a staggered manner to increase a flow resistance of the air flow). However, care should be taken on keeping the pre-condensation rate in the first conduit elements within sensible boundaries in view of thermal efficiency. In addition, such exemplary embodiments allow arranging the at least one heat emitting electric and/or electronic power component on an opposite side of the at least one thermosyphon heat exchanger such that they are visible from the condenser portion, instead. The advantage in such an exemplary embodiment resides in an optimized (e.g., very small) thickness. In case that the heat emitting electric and/or electronic power component measures less than the condenser portion with the second conduit elements in thickness, when seen in the direction of the ambient flow, providing an exemplary embodiment of a thermosyphon heat exchanger device having a thickness of merely the heat absorbing and heat releasing portion can be achievable. Depending on the exemplary embodiment, the heat emitting electric and/or electronic power components can be provided and thermally connected on both sides of the heat releasing portion.

Alternatively it can be very advantageous to use the first and second conduit elements with about the same length and connect the top and bottom manifolds directly. If the first and second conduit elements have about the same length, the like conduit elements can be used for both sets which can reduce the costs for producing the sets of conduits (e.g., the stacks).

A further advantage can reside in that the first set of first conduit elements and the second set of second conduit elements have the same arrangement, i.e., alignment and/or orientation, for example. Thus, the sets can be produced in the same process and further production costs can be saved.

It can be especially advantageous that the second conduit elements (e.g., at least two neighboring second conduit elements) can be thermally contacted by cooling fins arranged in between at least two neighboring second conduit elements for enlarging the amount of heat released from the second conduit elements. However, other cooling aids such as a mesh, for example, are possible.

A good aid for providing both the desired lateral distance between the conduit elements of the same set of conduits as well as the desired alignment of the latter can be achievable by a gauge (e.g., a calibre) serving as the model template for the distance and the alignment of the conduit elements. For this purpose, one exemplary embodiment of the gauge can be of a sheet type suitable for being connected to the conduit elements (e.g., by means of brazing). The gauge can have a comb-like appearance with keyways/recesses for receiving the conduit elements. Assuming, a set of conduits has two gauges that are connected to the end-faced manifolds, the gauges can contribute to an easy manufacturability of the heat exchanger device. Depending on the desired specification, one or several gauges with recesses in the form of oblong holes for receiving the conduits can be suitable, too. Such an exemplary embodiment may be obtained, for example, by sheet punching. Although they involve a different inserting of the conduits into their oblong holes compared to comb-like embodiments, the advantages can remain the same.

The provision of at least one gauge with at least two recesses for receiving a corresponding number of conduit elements can improve not only the structural rigidity of the heat exchanger device but also can contribute to an efficient manufacturability of the latter. The at least one gauge is structurally connected to at least one of the first and the second set of conduit elements. Variations of the gauge/gauges are conceivable (e.g., gauges with a U-shaped cross-sections where the recesses penetrate both brackets, gauges that are at least partly integrated into the manifolds or entirely separated thereof). In a further exemplary embodiment of the heat exchanger device, the gauge features recesses for receiving both the conduit elements of the first and the second set/sets of conduit elements.

The exemplary thermosyphon heat exchanger disclosed herein can be a gravity-type thermosyphon. However, it is not limited to a strictly perpendicular alignment of the first and second conduit elements. The alignment can be subject to variations (e.g., if their orientation is amended by rotating them about a virtual transversal axis defined by the shape of the top, bottom and/or intermediate manifold, as long as their function remains untouched and as long as the evaporating section of the first conduit elements is not running dry).

An exemplary electric and/or electronic device including at least one heat emitting electric and/or electronic power component can be thermally connected to at least one exemplary thermosyphon heat exchanger. The heat emitting electric and/or electronic power component can be formed, for example, by semiconductor components, resistors, printed circuitry and the like.

Figure 2:
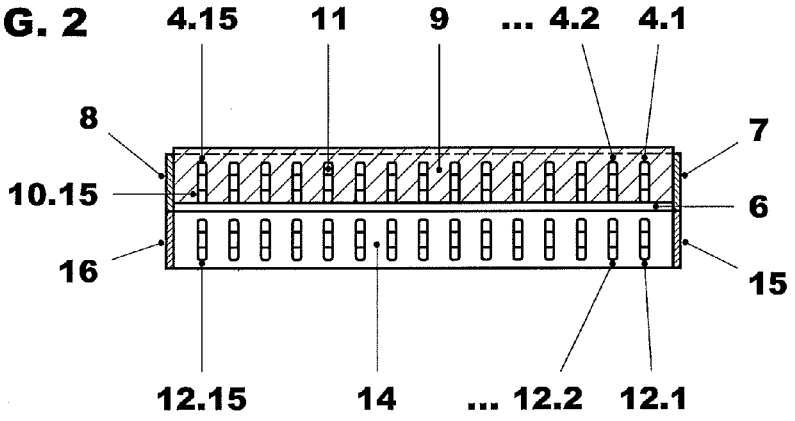
FIG. 2 is a cross-sectional view through section A of the heat absorbing plate in FIG. 1.
Figure 3:
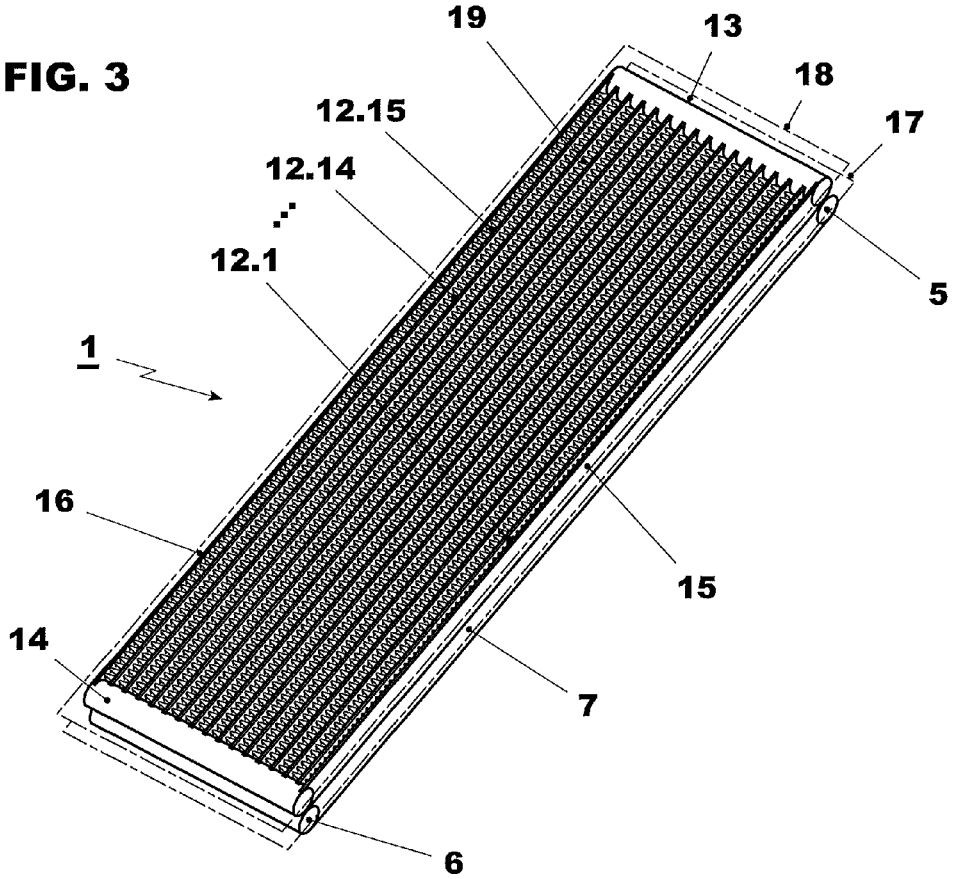
FIG. 3 is a schematic, three-dimensional illustration of the first exemplary embodiment of the thermosyphon heat exchanger when viewed towards a second set of second conduit elements.

FIGS. 1, 2 and 3 show a first exemplary embodiment of the disclosure. FIG. 1 shows a three-dimensional view of an exemplary thermosyphon heat exchanger 1. The thermosyphon heat exchanger 1 includes two sets 2 and 3 of multiport extruded tubes as conduit elements. It is to be noted that there is no limitation of the disclosure to stacking only two sets of conduit elements. The first set 2 of first multiport extruded tubes 4.1 to 4.15 as first conduit elements can be arranged between a first top manifold 5 and a first bottom manifold 6, wherein top and bottom indicate the general mode of use of the exemplary thermosyphon heat exchanger 1. The first multiport extruded tubes 4.1 to 4.15 are provided for vaporizing a refrigerant contained in the first multiport extruded tubes 4.1 to 4.15 and being supplied from the connected bottom manifold 6.

The manifolds 5 and 6 are circular cylinders which are arranged in parallel. However, other cross sections for the manifolds are possible (e.g., a rectangular shape) as long as their function remains unaffected. Each of the first multiport extruded tubes 4.1 to 4.15 can include several fluidly separated sub-tubes which open at the top and bottom end of the first multiport extruded tubes 4.1 to 4.15. The first multiport extruded tubes 4.1 to 4.15 can be connected in such a way to the manifolds 5 and 6 that the openings of the sub-tubes of the first multiport extruded tubes 4.1 to 4.15 at their top and bottom ends open into the top and bottom manifold 5 and 6, respectively, and such that any refrigerant liquid or vapor leakage can be prevented.

The first multiport extruded tubes 4.1 to 4.15 can be arranged about perpendicular to the cylinder axes of the manifolds 5 and 6 at the circular outer walls of the manifolds 5 and 6. The rectangular (e.g., the perpendicular) arrangement does not restrict the disclosure because other angular arrangements can be possible.

The first multiport extruded tubes 4.1 to 4.15 within the first stack/set 2 can be arranged in one single row and parallel to each other. The first set 2 can be additionally stabilized by the frame elements 7 and 8 which are mounted on the ground areas of the cylinders of the manifolds 5 and 6 or at the circular walls next to the ground areas of the cylinders of the manifolds 5 and 6. For purposes of description herein, the terms "ground", "upper", "lower", "left", "rear", "right", "front", "vertical", "horizontal", and derivatives thereof shall relate to the disclosure as oriented in the figures to ease the understanding of the present disclosure. Thus, these terms shall not be limited to exactly such an orientation as shown in the figures unless it is expressly specified to the contrary.

A heat absorbing plate 9 can be connected to the first multiport extruded tubes 4.1 to 4.15 in an area of the first set 2 of first multiport extruded tubes 4.1 to 4.15 next to the first bottom manifold 6 preferably by soldering. Any device that needs cooling can be mounted on the heat absorbing plate 9. Where necessary, the absorbing plate may feature topography (e.g., stepped areas at displaced levels) without abandoning the gist of the present disclosure. The exemplary thermosyphon heat exchanger 1 can be especially convenient for power electronic modules which are normally soldered to the heat absorbing plate 9 for an optimal heat transport.

FIG. 2 shows a cross-sectional view A of the exemplary thermosyphon heat exchanger 1 at the height of the heat absorbing plate 7 shown in FIG. 1. The exemplary heat absorbing plate 9 has grooves 10.1 to 10.15 each in a shape corresponding to the form of the profile and in the same arrangement of the multiport extruded tubes 4.1 to 4.15 such that the heat absorbing plate 9 can be easily plugged with the grooves on the first multiport extruded tubes 4.1 to 4.15. The grooves 10.1 to 10.15 can have the same depth in a direction perpendicularly to the row of the set/stack of conduits (e.g., as the first multiport extruded tubes 4.1 to 4.15) such that a optimal thermal contact surface of the first multiport extruded tubes 4.1 to 4.15 with the surface of the heat absorbing plate 9 in the grooves 10.1 to 10.15 can be established and the grooves 10.1 to 10.15 surround the first multiport extruded tubes 4.1 to 4.15 on three sides. The meaning of surrounding in this application and in the context of the grooves 10.1 to 10.15 can include not only the encasing of the first multiport extruded tubes 4.1 to 4.15 by the grooves 10.1 to 10.15, but also the encompassing of the first multiport extruded tubes 4.1 to 4.15 with the maximum contact to them which still allows the plugging of the heat absorbing plate 9 on the first multiport extruded tubes 4.1 to 4.15. The heat absorbing plate 9 can be soldered to the first multiport extruded tubes 4.1 to 4.15 to establish optimal heat conductivity from the heat absorbing plate 9 to the first multiport extruded tubes 4.1 to 4.15 or to the refrigerant within them, respectively.

FIG. 2 shows an exemplary parallel arrangement of the first multiport extruded tubes 4.1 to 4.15. The overall profile of the first multiport extruded tubes 4.1 to 4.15 can be basically rectangular in the cross-section, wherein the smaller sides of the quasi-rectangular cross-section can be rounded here. The lateral, flat sides can be larger than the circular end sides of the MPE's and the first multiport extruded tubes 4.1 to 4.15 can be arranged in parallel to each other such that the larger sides face each other to guarantee maximum space between the first multiport extruded tubes 4.1 to 4.15. This contributes to high cooling air flow speeds and a maximum surface for the air flow to pass. This can be especially important for the region where no heat absorbing plate 9 may be present. For example, the flat sides of the first multiport extruded tubes 4.1 to 4.15 can have approximately the same size as the cylinder-diameter of the manifolds 5 and 6 or a little bit smaller. The thickness (e.g., the size of the smaller side) of the profile of the first multiport extruded tubes 4.1 to 4.15 can be chosen regarding the cooling requirements, available cooling power of the cooling air flow and the properties of the refrigerant in a liquid and vaporized state. The properties of the refrigerant can determine as well the form, number and size of the sub-tubes 11 in the first multiport extruded tubes 4.1 to 4.15.

As seen in FIG. 2, the second set 3 of second multiport extruded tubes 12.1 to 12.15 as second conduit elements has the same profile and arrangement as the set 2 of first multiport extruded tubes 4.1 to 4.15. However, they differ in their functionality, because they are provided for condensing the refrigerant.

FIG. 3 shows a three-dimensional view of the exemplary thermosyphon heat exchanger 1 from another point of view with respect to FIG. 1. The observer looks now on the second set 3 of second multiport extruded tubes 12.1 to 12.15. The second set 3 of second multiport extruded tubes 12.1 to 12.15, the top manifold 13 and the bottom manifold 14 can be constructed identically to the first set 2 of first multiport extruded tubes 4.1 to 4.15, the top manifold 5 and the bottom manifold 6. The first and second top manifolds 5 and 13 can be connected to each other and the first and second bottom manifolds 6 and 14 can be connected to exchange the refrigerant. Thus, in this example, both sets of conduit elements connect their respective top and bottom manifolds directly. The heat absorption from the power emitting devices can be performed by the heat absorbing plate 9 mounted between the top and bottom manifolds 5, 6 of the first set.

The only difference between the two sets 2 and 3 can be that a heat absorbing plate 9 is soldered only to the first set 2 and in that the fins 19 are mounted only on the second set 3 between the second multiport extruded tubes 12.1 to 12.15 and between the frame elements 15 and 16 and the second multiport extruded tubes 12.1 and 12.15 to enlarge the cooling surface of the set 3.

The frame elements 15 and 16 may contribute as well as the structurally effective frame elements 7 and 8 of the first exemplary embodiment to an enhanced mechanical rigidity to the exemplary thermosyphon heat exchanger. Additional advantages can be achievable if these frame elements feature fixation means such as tapped holes for a fixation of the exemplary thermosyphon heat exchanger in a superior structure and may assist a lateral shielding of the conduits against lateral impacts. Depending on the exemplary embodiment, the structural rigidity of the conduits and the manifolds may satisfy the demands such that frame elements may be omitted, such as shown in the second exemplary embodiment of the thermosyphon heat exchanger.

The fins 19 are indicated only rudimentarily but range over the complete length of the second multiport extruded tubes 12.1 to 12.15. Alternatively, the fins 19 can range only over that part of set 3 which is not covered in the corresponding set 2 by the heat absorbing plate 9. The cooling effect in the part of the heat absorbing plate 9 can be reduced anyway, because the air flow can not pass the heat absorbing plate 9.

A first region 17 of the first set 2 for the first exemplary embodiment of the disclosure can be defined as the entire length of the first set 2 and accordingly, a second region 18 of the second set 3 can be the entire region of the second set 3. The region 17 or 18 can be a limited area of a layer spanned by the two parallel axes of the top and bottom manifold 5 and 6 or 13 and 14, respectively, when seen as a front face projection. The two sets 2 and 3 can be arranged in a stacked manner. The first and second region overlap each other completely (e.g., in this exemplary embodiment, the first set 2 covers second set 3 completely and the second set 3 covers first set 2 completely). The stacked arrangement of the two sets 2 and 3 has an advantage that the width and height of the exemplary thermosyphon heat exchanger 1 remains small and only the relative thin overall thickness defined by the thickness of set 2 and 3, which in term can be defined by the dimensions of the manifolds and/or the conduit profiles, doubles in size. The same size of the two sets 2 and 3 allows as well connecting the top manifolds 5 and 13 directly to one another and the bottom manifolds 6 and 14, respectively, without involving any further tube or another connecting element.

With this separate arrangement of the conduit elements for vaporizing in a first set of conduit elements and of the conduit elements for condensing in a second set of conduit elements, each set of conduit elements can be adapted to the particular requirements. For example, the first set of conduit elements for vaporizing can be enlarged to realize higher heat flux densities without decreasing the condensing area. Using a stacked arrangement of these two separated sets, the sets can be adapted individually and the construction space may not enlarged remarkably.

In the following, the functionality of the thermosyphon heat exchanger 1 will be described by reference to exemplary FIGS. 1 to 3. The exemplary thermosyphon heat exchanger 1 must be arranged for operation such that the top manifolds have potential energy versus the bottom manifolds (e.g., the top manifold can be arranged over the bottom manifold). For example, the first multiport extruded tubes 4.1 to 4.15 can be vertically arranged (e.g., they follow the direction of the gravitational force).

The electronic power module soldered on the heat absorbing plate 9 produces heat which can be conducted over the contact surface between the heat absorbing plate 9 and the electronic power module to the heat absorbing plate 9. The rising temperature of the heat absorbing plate 9 (e.g., the absorbed thermal energy) heats up the first multiport extruded tubes 4.1 to 4.15, where they are in contact with the heat absorbing plate 9. Since the sub-tubes 11 of the first multiport extruded tubes 4.1 to 4.15 include a refrigerant, the thermal energy from the heat absorbing plate 9 vaporizes the liquid refrigerant to a refrigerant-vapor. Basically, the refrigerant-vapor rises in the vertical first multiport extruded tubes 4.1 to 4.15 to the first top manifold 5 and further to the connected second top manifold 13. Because the second top manifold 13 can be connected with the sub-tubes 11 of the second multiport extruded tubes 12.1 to 12.15, the refrigerant-vapor flows into the sub-tubes 11 of the second multiport extruded tubes 12.1 to 12.15.

The exemplary thermosyphon heat exchanger 1 can be actively cooled, for example, by a fan which is not shown in the drawing. The fan is mounted generating an air-flow about perpendicular towards the second multiport extruded tubes 12.1 to 12.15 and about perpendicular/rectangular to the row second multiport extruded tubes 12.1 to 12.15 on the side of the second set 3. Thus, the air flow passes between all second multiport extruded tubes 12.1 to 12.15 whose surface of contact with the air flow is enlarged by the fins 19. Therefore, the second multiport extruded tubes 12.1 to 12.15 which are heated up by the refrigerant-vapor can be cooled down by the air flow of the fan which transports away the heat of the fins 19 and of the second multiport extruded tubes 12.1 to 12.15. When the temperature of the refrigerant decreases to the vaporizing temperature, the refrigerant-vapor condenses back to its liquid phase. The liquid refrigerant can be conducted over the bottom manifolds 14 and 6 back to the first multiport extruded tubes 4.1 to 4.15 where the circuit starts again.

Figure 4:
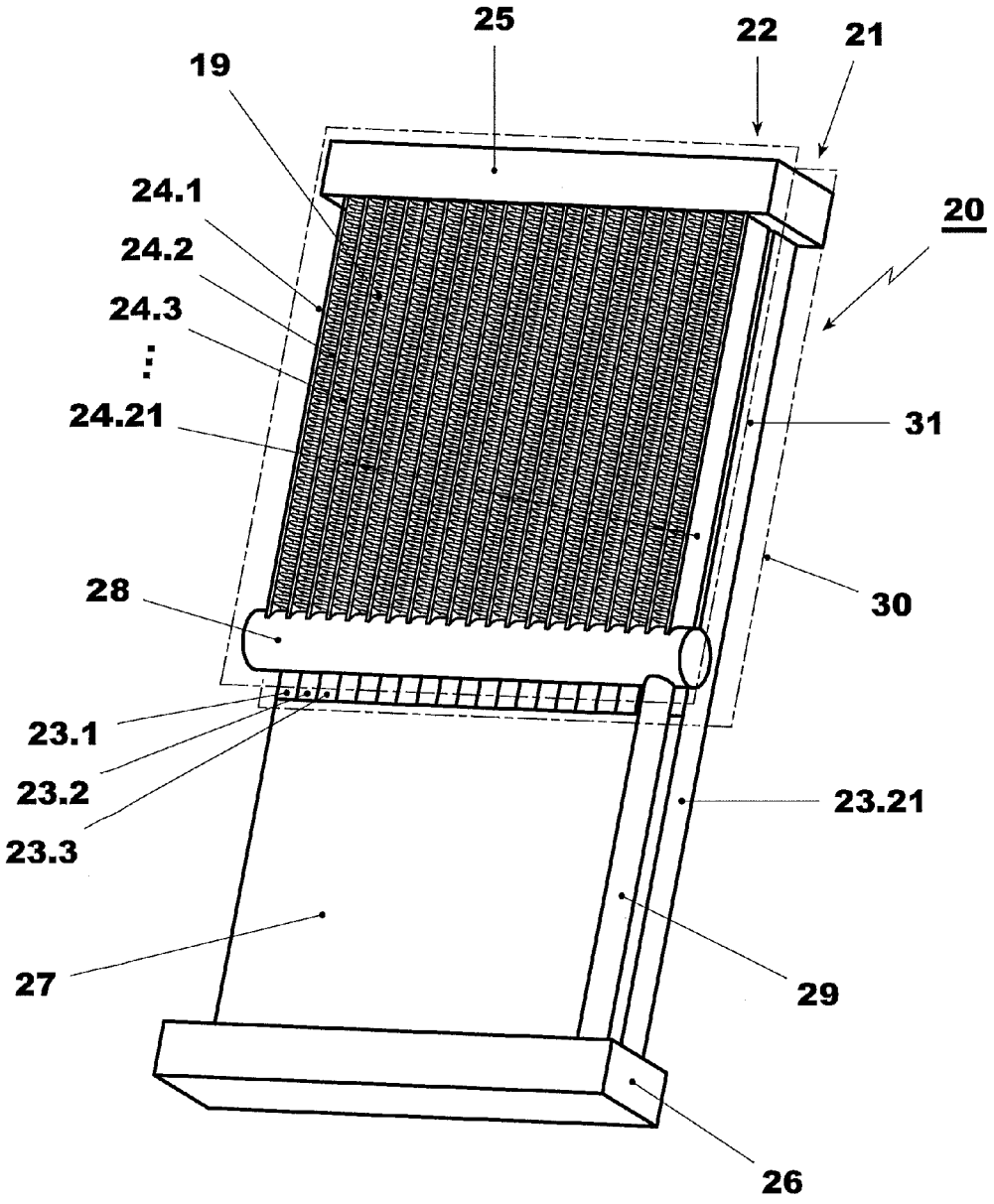
FIG. 4 is a schematic, three-dimensional illustration of a second exemplary embodiment of a thermosyphon heat exchanger when viewed towards a second set of the second conduit elements.

FIG. 4 shows a second exemplary embodiment according to the disclosure. A exemplary thermosyphon heat exchanger 20 has again a first set 21 of first multiport extruded tubes 23.1 to 23.21 and a second set 22 of second multiport extruded tubes 24.1 to 24.21. Instead of two top manifolds 5 and 13 and two bottom manifolds 6 and 14, the exemplary thermosyphon heat exchanger 20 shows only one common top manifold 25 and one common bottom manifold 26. The manifolds 25 and 26 have the form of cuboids. However, other shapes are possible. The multiport extruded tubes can have the same profile as those in the first exemplary embodiment.

The top end of the first and second multiport extruded tubes 23.1 to 23.21 and 24.1 to 24.21 can each be mounted rectangular/perpendicular to one side of the top manifold 25 such that the sub-tubes of the first and second multiport extruded tubes, 23.1 to 23.21 and 24.1 to 24.21, fluidly open into the top manifold 25. The first multiport extruded tubes 23.1 to 23.21 can be arranged in a first row, while the second multiport extruded tubes 24.1 to 24.21 can be arranged in a neighboured layer in a second row. The twenty-one first multiport extruded tubes 23.1 to 23.21 of the first set 21 can be arranged relative to the twenty-one second multiport extruded tubes 24.1 to 24.21 of the second set 22 such that each pair of corresponding first and second multiport extruded tubes 23.*i* and 24.*i* with i=1, . . . , 21, can be arranged in a layer perpendicular to the layer of the row of first multiport extruded tubes 23.1 to 23.21 or to the layer of the row of the second multiport extruded tubes 24.1 to 24.21. The layer of the corresponding first and second multiport extruded tubes 23.*i* and 24.*i* can be defined, for example, by the corresponding side walls of the larger sides of profile of the multiport extruded tubes. Thus, the first multiport extruded tube 23.*i* can be located in the slip stream of the second multiport extruded tube 24.*i*, when a fan that is located on the side of set 22 creates an air flow towards the latter with the direction perpendicular to each of the two rows of multiport extruded tubes.

In the second exemplary embodiment, the first multiport extruded tubes 23.1 to 23.21 can be longer than the second multiport extruded tubes 24.1 to 24.21 in the direction of the longitudinal axis. In the region where the first multiport extruded tubes 23.1 to 23.21 are not accompanied by the second multiport extruded tubes 24.1 to 24.21, the heat absorbing plate 27 can be soldered to the first multiport extruded tubes 23.1 to 23.21 like to the heat absorbing plate 9 of the first exemplary embodiment. An additional heat absorbing plate 27 can be thermally connected to the first multiport extruded tubes 23.1 to 23.21 from the side where the second set 22 is arranged. Thus, the electronic power module (not shown in FIG. 4) can be fastened (e.g., by screws) on the absorbing plate 27 in the direction of the set 22 which additionally saves construction space without loosing cooling power. The electronic power module does not protrude a fictional, lateral silhouette of the thermosyphon heat exchanger 20 on the outer side of the set 21 as in the first exemplary embodiment, but fits in the recess portion of the thermosyphon where in the first exemplary embodiment the second multiport extruded tubes 12.1 to 12.21 extend without losing any remarkable cooling effect, because the air stream of the fan can not pass the heat absorbing plate 9.

The bottom ends of the second multiport extruded tubes 24.1 to 24.21 can be connected to and fluidly open into an intermediate manifold 28 arranged between the top manifold 25 and the bottom manifold 26. The intermediate manifold 28 can have the shape of a circular cylinder, whose axis of the cylinder can be perpendicular to the longitudinal axis defined by the second multiport extruded tubes 24.1 to 24.21. The second multiport extruded tubes 24.1 to 24.21 can be mounted on the circular shell wall at the top side of the intermediate manifold 28. The intermediate manifold 28 can be fluidly connected over a return line 29 with the bottom manifold 26. The return line 29 can be mounted to the circular wall at the bottom side of the intermediate manifold 28, for example, next to one of the ground areas of the power electronic module such that it does not interfere with the construction space. Alternatively, the intermediate manifold 28 can be arranged with a slight inclination towards the opening of the tube 29 to assist the fluid flow from the intermediate manifold 28 to the bottom manifold 26. This causes the second multiport extruded tubes from 24.1 becoming longer versus 24.21 with reference to the longitudinal axis.

The bottom ends of the first multiport extruded tubes 23.1 to 23.21 can be mounted on the bottom manifold 26 rectangular to the one side of the bottom manifold 26. Thus, the top and bottom manifolds 25 and 26 can be arranged in parallel to each other. The sub-tubes of the first multiport extruded tubes 23.1 to 23.21 fluidly open into the bottom manifold 26 each. The functionality of the thermosyphon heat exchanger 20 according to the second exemplary embodiment of the disclosure is analagous to the thermosyphon heat exchanger 1, except that the intermediate manifold 28 can collect the condensed refrigerant and conduits the refrigerant over the tube 29 to the bottom manifold 26.

A first region 30 of the set 21 of first multiport extruded tubes 23.1 to 23.21 can be defined as the region between the heat absorbing plate 27 and the top manifold 25. A second region 31 of the set 22 of second multiport extruded tubes 24.1 to 24.21 can be defined as the complete set 22 (e.g., as the surface enclosed by the top manifold 25 and the intermediate manifold 28). The first and second region overlap and are arranged in neighboured layers. Thus, the thermosyphon heat exchanger 20 has a first row of first multiport extruded tubes 23.1 to 23.21 and a second row of second multiport extruded tubes 24.1 to 24.21. The second row can be arranged in a neighboured layer to the first row and such that the second row covers the first region 30 of the first row.

The disclosure is not restricted to a set of first multiport extruded tubes with only one row of multiport extruded tubes. The set of first multiport extruded tubes can show even two or more rows of first multiport extruded tubes. The set of first multiport extruded tubes should show at least one row of multiport extruded tubes. The same holds accordingly true for the set of second multiport extruded tubes.

At least one of the set of first multiport extruded tubes and of the set of second multiport extruded tubes can be arranged between the top manifold and the bottom manifold without any intermediate manifold. An intermediate manifold in this context can be a manifold arranged in between the top manifolds or the top manifolds and the bottom manifold or the bottom manifolds. The set without the intermediate manifold can, for example, be the set on the evaporator side.

The material of the heat absorbing plate 9, the manifolds 5, 6, 13, 14, 25, 26 and 28 and the multiport extruded tubes 4.1 to 4.15, 12.1 to 12.15, 23.1 to 23.21 and 24.1 to 24.21 can normally be aluminium or any aluminium alloy which combines good heat conduction properties with small weight or any other suitable material.

The disclosure is not restricted to the described manifold forms. All geometric descriptions of arrangements are not restricted to the mathematical exact definition but also include the impreciseness of production and arrangements which nearly correspond to the described arrangements.

The disclosure is not restricted to the described exemplary embodiments. The features of the described exemplary embodiments can be combined in each advantageous way.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A thermosyphon heat exchanger, comprising:

an evaporator including at least one first set of a plurality of first conduit elements for a refrigerant for absorbing heat; and a condenser including at least one second set of a plurality of second conduit elements for releasing the heat previously absorbed by the refrigerant in the at least one first set of first conduit elements, a first end of the at least one first set of first conduit elements being fluidly connected to a first end of the at least one second set of second conduit elements by at least one manifold and a second end of the at least one first set of first conduit elements being fluidly connected to a second end of the at least one second set of second conduit elements by at least another manifold and configured to form a closed loop through the at least one first set of first conduit elements, the at least one second set of second conduit elements and the manifolds, the at least one first set of first conduit elements and the at least one second set of second conduit elements being at least partially arranged such that a stack is formed and arranged such that a cooling air stream hits the second conduit elements prior to coming in contact with the first conduit elements when passing through the stack in an operating state of the thermosyphon heat exchanger, wherein at least one of the first set of first conduit elements comprises at least one thermally connected heat absorbing plate for connecting a heat producing electronic device and wherein the heat absorbing plate comprises a plurality of grooves that receive the at least one first set of first conduit elements at least partly.

2. The thermosyphon heat exchanger according to claim 1, wherein at least one of the first conduit elements and the second conduit elements are multiport extruded tubes.

3. The thermosyphon heat exchanger according to claim 1, wherein the first conduit elements within the at least one first set are arranged in parallel to each other and/or the second conduit elements within the at least one second set are arranged in parallel to each other.

4. The thermosyphon heat exchanger according to claim 1, wherein the first end of the at least one first set of first conduit elements and the first end of the at least one second set of second conduit elements are fluidly connected by a common manifold.

5. The thermosyphon heat exchanger according to claim 1, wherein the first end of the at least one first set of first conduit elements is fluidly connected by a first manifold and/or the first end of the at least one second set of second conduit elements is fluidly connected by a second manifold, wherein the first manifold and the second manifold are fluidly connected.

6. The thermosyphon heat exchanger according to claim 1, wherein the heat absorbing plate covers less than half of the first conduit elements in a longitudinal direction defined by at least one of the thermosyphon heat exchanger, the first conduit elements and the second conduit elements.

7. The thermosyphon heat exchanger according to claim 1, wherein the at least one first set of first conduit elements and the at least one second set of second conduit elements are arranged congruently in the stack in terms of a number and an alignment of conduit elements.

8. The thermosyphon heat exchanger according to claim 1, wherein the first conduit elements and the second conduit elements have about a same length.

9. The thermosyphon heat exchanger according to claim 1, wherein the second conduit elements are shorter than the first conduit elements.

10. The thermosyphon heat exchanger according to claim 9, wherein the second conduit elements are displaced about a distance in a direction of a longitudinal axis to the heat absorbing plate.

11. The thermosyphon heat exchanger according to claim 1, wherein the at least one first set of first conduit elements and the at least one second set of second conduit elements have a same arrangement of conduit elements.

12. The thermosyphon heat exchanger according to claim 1, wherein at least two second conduit elements are thermally connected by fins located in between two neighboring second conduit elements.

13. The thermosyphon heat exchanger according to claim 1, wherein at least one gauge is structurally connected to at least one of the first and the second set of conduit elements.

14. The thermosyphon heat exchanger according to claim 1, wherein at least two sets of the at least one first set of first conduit elements and the at least one second set of second conduit elements are fluidly connected to one another by detachable couplings.

15. The thermosyphon heat exchanger according to claim 1, wherein the first end of the at least one first set of first conduit elements is connected to the first end of the at least one second set of second conduit elements directly via the at least one manifold with no intervening mechanical systems for implementing a phase change of the refrigerant and the second end of the at least one first set of first conduit elements is fluidly connected to the second end of the at least one second set of second conduit elements directly via the at least another manifold with no intervening mechanical systems for implementing a phase change of the refrigerant.

16. The thermosyphon heat exchanger according to claim 1, comprising an intermediate manifold arranged between the at least one manifold and the at least another manifold.

17. An electric and/or electronic device, comprising:

at least one heat emitting electric component that is thermally connected to at least one thermosyphon heat exchanger, the thermosyphon heat exchanger comprising:

an evaporator including at least one first set of a plurality of first conduit elements for a refrigerant for absorbing heat; and a condenser including at least one second set of a plurality of second conduit elements for releasing the heat previously absorbed by the refrigerant of the at least one first set of first conduit elements, a first end of the at least one first set of first conduit elements being fluidly connected to a first end of the at least one second set of second conduit elements by at least one manifold and a second end of the at least one first set of first conduit elements being fluidly connected to a second end of the at least one second set of second conduit elements by at least another manifold and configured to form a closed loop through the at least one first set of first conduit elements, the at least one second set of second conduit elements and the manifolds, the at least one first set of first conduit elements and the at least one second set of second conduit elements being at least partially arranged such that a stack is formed, wherein at least one of the first set of first conduit elements comprises at least one thermally connected heat absorbing plate for connecting a heat producing electronic device and wherein the heat absorbing plate comprises a plurality of grooves that receive the at least one first set of first conduit elements at least partly.

18. The electric and/or electronic device according to claim 17, wherein the first end of the at least one first set of first conduit elements is connected to the first end of the at least one second set of second conduit elements directly via the at least one manifold with no intervening mechanical systems for implementing a phase change of the refrigerant and the second end of the at least one first set of first conduit elements is fluidly connected to the second end of the at least one second set of second conduit elements directly via the at least another manifold with no intervening mechanical systems for implementing a phase change of the refrigerant.

* * * * *

UNITED STATES PATENT AND TRADEMARK OFFICE

CERTIFICATE OF CORRECTION

PATENT NO. : 9,007,771 B2
APPLICATION NO. : 12/768339
DATED : April 14, 2015
INVENTOR(S) : Bruno et al.

It is certified that error appears in the above-identified patent and that said Letters Patent is hereby corrected as shown below:

On the title page item [30] insert Foreign Application Priority Data, -- April 29, 2009 (EPO) 09158996.0 --.

Signed and Sealed this
Twenty-ninth Day of December, 2015

Michelle K. Lee

Michelle K. Lee
*Director of the United States Patent and Trademark Office*